United States Patent [19]

Zacharias

[11] 4,377,941

[45] Mar. 29, 1983

[54] ROLLING MILLS WITH VARIED SIZE ANGULARLY DISPLACEABLE ROLL

[75] Inventor: Theodor Zacharias, Meerbusch, Fed. Rep. of Germany

[73] Assignee: Kocks Technik GmbH & Company, Hilden, Fed. Rep. of Germany

[21] Appl. No.: 255,387

[22] Filed: Apr. 20, 1981

[30] Foreign Application Priority Data

Jul. 9, 1980 [DE] Fed. Rep. of Germany ..... 3025897

[51] Int. Cl.[3] ..... B21B 23/00; B21B 35/14

[52] U.S. Cl. ..... 72/224; 72/249; 72/431

[58] Field of Search ..... 72/224, 235, 246, 249, 72/431, 434, 225, 248; 464/153, 154; 226/186, 190, 194; 29/148.4 D

[56] References Cited

U.S. PATENT DOCUMENTS

| | | | |
|---|---|---|---|
| 2,841,966 | 7/1958 | Belden et al. | 464/154 |
| 3,831,417 | 8/1974 | Ritter et al. | 72/249 |
| 3,898,830 | 8/1975 | Borisenko | 72/249 |

*Primary Examiner*—Francis S. Husar
*Assistant Examiner*—Jonathan L. Scherer
*Attorney, Agent, or Firm*—Buell, Blenko, Ziesenheim & Beck

[57] ABSTRACT

A rolling mill is provided in which the stands can be angularly displaced about the longitudinal axis of the work material so that the drive shaft slopes upwardly or downwardly from the associated output spindle of the drive transmission. This enables rolls of ideal diameter ($D_i$) larger or smaller by up to 20 mm than the rated ideal diameter for that stand location to be used. A flexible coupling compensates for the angular misalignment of up to 2° between the drive shaft and the output spindle.

5 Claims, 2 Drawing Figures

ROLLING MILLS WITH VARIED SIZE ANGULARLY DISPLACEABLE ROLL

Figure 1:
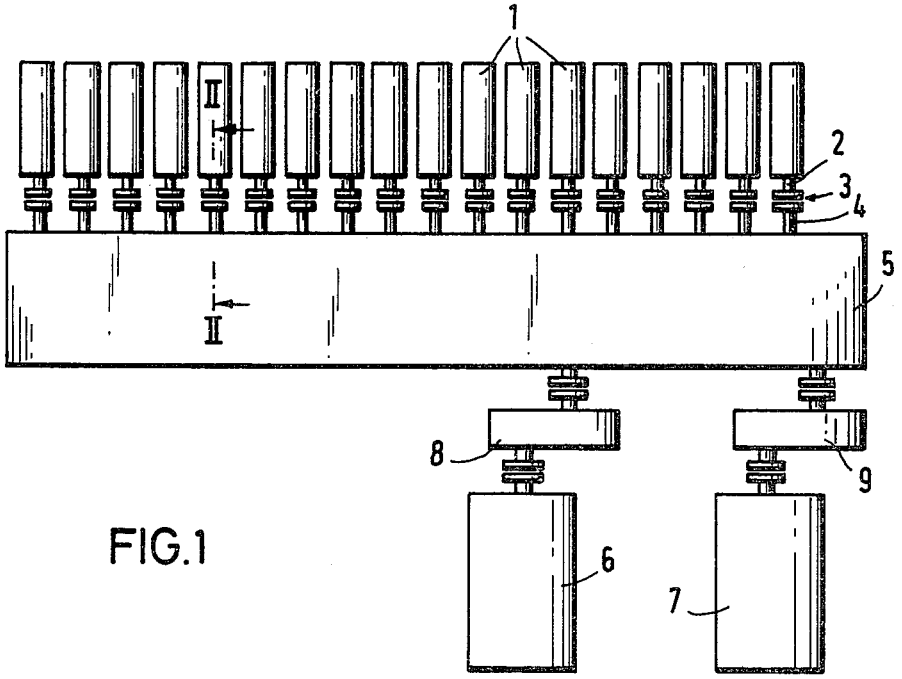

This invention relates to rolling mills and particularly to tube rolling mills in which the roll stands can be angularly displaced about the longitudinal axis of the work material.

Tube rolling mills, such as stretch-reducing rolling mills, having a plurality of rolling stands which are arranged one after the other in the rolling direction and which are interchangeably disposed in stand beds and have radially non-adjustable rolls which are driven by one or a plurality of motors by way of transmission mechanisms, flexible couplings and drive shafts of the rolling stands are known.

In rolling mills of this kind, it is customary to keep the ideal diameter of the rolls (that is to say, twice the distance of the axis of the rolls from the longitudinal axis of the work material), the same in all the rolling stands. In special cases, particularly in rolling mills having a very large number of stands, it is known to sub-divide the stands into groups and to use ideal roll diameters which differ by groups and which become smaller when viewed in the rolling direction. In such a case, since the rolls or their axles are not radially adjustable, it is necessary to use different rolling stands in which the axles of the rolls are at different distances from the longitudinal axis of the work material. Consequently, the distances between the axes of the stand drive shafts and the longitudinal axis of the work material differ in the individual groups of stands, and thus also the position of the couplings which connect the stand drive shafts to the respective output shafts of the transmission or transmissions.

As a result of this, in rolling mills having ideal roll diameters which differ in groups, the rolling stands and the rolls can only be fitted in the stand beds which are associated with the relevant group. Although rolls which are worn, and which are located in the rear stands of their group when viewed in the rolling direction, can be reconditioned and, provided with a larger sizing pass, can be fitted at the rolling stand locations, located upstream in the rolling direction, of the same group of stands, they can only be fitted up to the first rolling stand location of this group in the rolling direction. When the rolls at this location become worn, they can no longer be used in the known type of construction if it is desired to continue to roll tubes with the same external diameter.

Although it would then still be possible to recondition the rolls to a smaller ideal diameter, so that they can be reused in a stand group having a smaller ideal roll diameter, this theoretical possibility does not exist in the known types of construction, since the differences in the ideal roll diameters from stand group to stand group are relatively large, thus requiring a considerable amount of uneconomical machining work. Moreover, the particularly hard material in the region of the peripheries of the rolls is lost. Furthermore, with the known large differences between the ideal roll diameters of the individual stand groups, difficulties arise owing to the differences between the diameters of the roll axles. That is to say, rolls having a larger ideal diameter also have roll axles of larger external diameters on account of the higher stability required. For the reasons given above, this possibility has not been considered practicable.

An object of the invention is to obtain a higher utilisation factor of the rolls so as to reduce the operating costs of rolling mills of this kind.

In accordance with the invention, a tube rolling mill has a plurality of rolling stands which are arranged one after the other in the rolling direction and which are interchangeably disposed in stand beds and have radially non-adjustable rolls which are driven by one or a plurality of motors by way of transmission mechanisms, flexible couplings and drive shafts on the rolling stands, the stands, at least the output end, being angularly displaceably mounted about the longitudinal axis of the work material with respect to the stand beds, whereby rolls can be used in the rolling stands whose ideal diameters are larger or smaller than the rated ideal diameter for that stand location, the stand drive shafts being inclined upwardly or downwardly relative to the respective output spindles owing to the larger or smaller radial distance of the stand drive shafts from the longitudinal axis of the work material, as the case may be, the flexible couplings compensating for the angular misalignment of the drive shafts relative to the output spindles of the transmission.

The rolls of the rolling stands may have an ideal diameter which is approximately 20 mm larger or smaller than the rated ideal diameter for the normal construction.

Thus, the rolls can be reconditioned a greater number of times and used again in a rolling mill which was originally designed for the same ideal roll diameters, and also in a rolling mill having a plurality of rolling stand groups having the same ideal roll diameters. By way of example, in contrast to passing through the rolling stand locations once as in the known types of construction, they can pass through the individual rolling stand locations of the relevant rolling stand groups several times, even though they pass through with different ideal diameters. Thus, a particular roll can first be used with a larger ideal diameter than the nominal diameter and, after wear and reconditioning can pass through the individual rolling stands of the rolling stand group with the retention of the ideal diameter and then is reduced to the next smaller ideal diameter such as the normal ideal diameter which can also be designed "nominal" or "rated" diameter. This renders it possible to re-incorporate even the smaller sizing passes which, after corresponding further wear, are then reconditioned only in the sense of increasing the sizing pass and are then used again from rolling stand location to rolling stand location in the opposite direction to the rolling direction. The same can be repeated again with a correspondingly smaller ideal roll diameter lying below the rated ideal roll diameter, so that, in the above-mentioned example, a particular roll is used in the same rolling stand group three times when producing the same tubes, before the roll has to be scrapped. The same also applies analogously to tube rolling mills which are designed only for one nominal ideal roll diameter.

The invention is advantageous in that the stand beds and the positions of the couplings, and thus also the transmission, can frequently remain unchanged within the entire rolling mill, at least in the region of a rolling stand group, although the ideal roll diameters and thus also the distances of the roll axles from the longitudinal axis of the work material vary. Thus, advantageously, it is also possible to use the invention in existing rolling mills and thus considerably reduce the operating costs of the rolling mills.

The above-mentioned advantages accrue by reason of the fact that the rolling stands can be fitted in the stand beds in an angularly displaced position, thus compensating for the differing distances of the stand drive shafts of the stands from the longitudinal axis of the work material. This difference in the distances of up to approximately 10 millimeters is distinctly less than the distance increments which exist between the individual rolling stand groups in the known types of construction. On the other hand, this difference in the distances or the corresponding difference between the ideal roll diameter and the normal construction, is sufficient to enable the rolls to be reconditioned several times and thus to re-use them more frequently than is possible in the known types of construction. Flexible couplings, which are already used in the known types of construction, are quite able to compensate for the slope which results from the angularly displaced installation of the rolling stands in the stand beds for the purpose of compensating for the differing distances between axes. It has proved to be advantageous if the stand drive shafts slope by an angle of up to approximately two degrees relative to the axial direction of the associated output shaft of the transmission. This angular difference can be permitted at the coupling without any great losses of transmissible torque.

The construction in accordance with the invention is of particular importance for the dimensioning rolling stands or dimensioning sizing passes in the region of the delivery end portion of the rolling mill, since this is where the smallest sizing pass cross sections exist which, as experience has shown, are subjected to the most rapid wear. Thus, it is advisable to use the invention at least at the stand beds which are at the rear in the rolling direction, although it is also advantageous to use the invention at the forward rolling stand locations.

Figure 2:
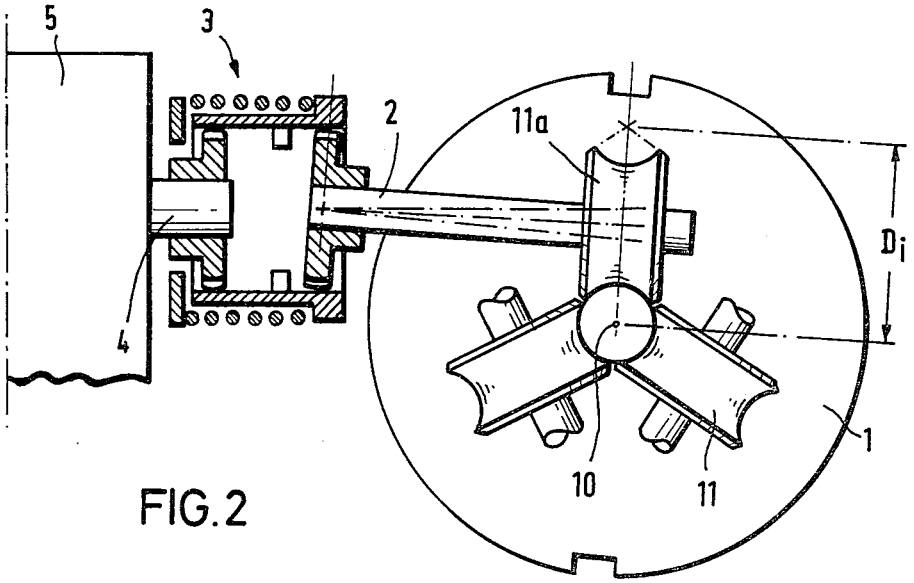

The invention is further described, by way of example, with reference to the drawings, in which:

FIG. 1 is a diagrammatic plan view of a stretch-reducing rolling mill together with its drive; and FIG. 2 is a detailed sectional view taken along the line II—II of FIG. 1, to a larger scale.

FIG. 1 shows a stretch-reducing rolling mill which has a large number of rolling stands 1 arranged one after the other in the rolling direction. Each rolling stand has a stand drive shaft 2, the drive shafts being coupled to the output spindles of a transmission 5 by way of respective couplings 3. The transmission 5 is driven by two motors 6 and 7, step-down gears 8 and 9 being interposed therebetween. The rolling stands 1 are fitted in stand beds (not illustrated), and are rigidly clamped during rolling operation. Since the external dimensions of the rolling stands 1 are the same, any rolling stand 1 can be fitted and clamped in any stand bed in the illustrated stretch-reducing rolling mill.

FIG. 2 clearly shows that the rolling stand 1 is fitted so as to be angularly displaceable about the longitudinal axis 10 of the work material, and the stand drive shaft 2 slopes relative to the output spindle 4 of the transmission 5. The coupling 3 compensates for the angular misalignment so produced. The illustrated arrangement of the rolling stand 1 occurs whenever the rolls 11 have already been reconditioned several times and have the smallest ideal roll diameter $D_i$ up to 20 mm smaller than the rated or normal dimension of the ideal roll diameter $D_i$, in the case of which the stand drive shaft 2 would be disposed exactly horizontally and the upper roll designated 11*a* would lie exactly vertically. In the case of the ideal roll diameter $D_i$ of completely new rolls 11 which would be larger by up to 20 mm than the rated diameter, the stand drive shaft 2 would slope in the opposite direction to that shown in FIG. 2, this also, of course, applying to the roll 11*a*. It will be appreciated that the rolls 11 and the entire rolling stand 1 including the roll axle bearings participate in this angular adjustment. In this manner, the ideal roll diameter $D_i$ can be varied within specific limits, without having to vary the position of the coupling 3 and of the output spindle 4 on the transmission 5. Thus, the rolls 11 can be reconditioned more frequently and, consequently, can be utilised to better effect than in the known types of construction.

In the foregoing specification I have set out certain preferred embodiments and practices of my invention, however, it will be understood that this invention may be otherwise embodied within the scope of the following claims.

I claim:

1. A tube rolling mill comprising a plurality of successive roll stands which are arranged one after the other in the rolling direction and which are interchangeably disposed in stand beds, a plurality of radially non-adjustable rolls in each stand, drive means for said rolls, flexible couplings and drive shafts connecting said rolls and drive means, at least a part of said roll stands being angularly displaceably mounted about the longitudinal axis of the work material with respect to the stand beds, whereby rolls can be used in the rolling stands whose ideal diameters are larger or smaller than the rated ideal diameter for that stand location, the stand drive shafts being inclined upwardly or downwardly relative to the respective output spindles owing to the larger or smaller radial distance of the stand drive shafts from the longitudinal axis of the work material, as the case may be, the flexible couplings compensating for the angular misalignment of the drive shafts relative to the output spindles of the transmission.

2. A tube rolling mill as claimed in claim 1, in which the stand drive shafts slope at an angle of up to approximately two degrees relative to the axial direction of the associated output spindle of the transmission.

3. A tube rolling mill as claimed in claim 1, having transmission means between the drive means and rolls.

4. A tube rolling mill as claimed in claim 1, wherein at least the roll stands at the output end of the mill are angularly displaceable.

5. A tube rolling mill as claimed in claim 1 or 2 or 3 or 4, in which the arrangement is such that rolls having ideal diameters up to 20 mm larger than and down to 20 mm smaller than the rated ideal diameter can be accommodated.

* * * * *